United States Patent [19]

Okutsu et al.

[11] Patent Number: 4,725,770

[45] Date of Patent: Feb. 16, 1988

[54] REFERENCE VOLTAGE CIRCUIT

[75] Inventors: Mitsuhiko Okutsu, Katsuta; Tatsuo Shimura, Hitachi; Tadaaki Kariya, Ibaraki; Kazuyoshi Masuda, Hitachi, all of Japan

[73] Assignees: Hitachi, Ltd.; Hitachi Engineering Co., both of Tokyo, Japan

[21] Appl. No.: 13,549

[22] Filed: Feb. 11, 1987

[30] Foreign Application Priority Data

Feb. 19, 1986 [JP] Japan ..... 61-32994

[51] Int. Cl.[4] ..... G05F 3/20

[52] U.S. Cl. ..... 323/313; 323/316

[58] Field of Search ..... 323/311, 312, 313, 316; 307/297

[56] References Cited

U.S. PATENT DOCUMENTS 4,570,114 2/1986 Heim ..... 323/313

4,675,592 6/1987 Tsuzuki ..... 323/313

*Primary Examiner*—Patrick R. Salce

*Assistant Examiner*—Judson H. Jones

*Attorney, Agent, or Firm*—Antonelli, Terry & Wands

[57] ABSTRACT

A reference voltage circuit in which an output reference voltage is stabilized against variations in power source as well as in transistor current amplification factor $h_{FE}$. In a reference voltage circuit comprising a DC power source connected to an output terminal, first and second resistors with their respective one ends commonly connected to the output terminal, a first NPN transistor with its collector shorted with its base and connected to the other end of the first resistor and its emitter grounded, a second NPN transistor with its collector connected to the other end of the second resistor and its base connected to the collector of the first NPN transistor, a third resistor connected between the emitter of the second NPN transistor and the ground, and a third NPN transistor with its collector connected to the output terminal, its base connected to the collector of the second NPN transistor and its emitter grounded, there are further provided a fourth resistor connected between the collector of the third NPN transistor and the output terminal and a PNP transistor with its base connected to the collector of the third NPN transistor, its emitter connected to the output terminal and its collector grounded.

11 Claims, 6 Drawing Figures

REFERENCE VOLTAGE CIRCUIT

BACKGROUND OF THE INVENTION

The present invention relates to a reference voltage circuit, and more particularly relates to a reference voltage circuit suitable for stabilization of a reference output voltage against variations in power source as well as in current amplification factor ($h_{FE}$) of transistors.

Heretofore, a band gap reference voltage circuit is known as a circuit for obtaining a stabilized reference voltage having a small temperature coefficient (reference is made to a book entitled "Shuseki Kailo Kogaku (2) (Integrated Circuit Engineering (2))", by Nagata & Yanai, published by Corona Co., pages 23 and 24). The circuit is shown in FIG. 1.

In FIG. 1, the reference voltage circuit comprises transistors 1 to 3, resistors 4 to 6, and a constant-current power source 7. The resistors 4 and 6 and the transistors 1 and 2 constitute a constant-current circuit which determines a current $I_2$ flowing in the resistor 5. An output voltage $V_0$ at an output terminal 100 is the sum of a potential difference $V_{BE3}$ between the base and the emitter of the NPN transistor 3 and a terminal voltage across the resistor 5. Because the potential difference $V_{BE3}$ has a negative temperature coefficient while the terminal voltage across the resistor 5 has a positive temperature coefficient, the resistor 5 can be suitably adjusted to make the whole temperature coefficient zero. If the current flowing in the resistor 4, the current flowing in the resistor 5, the resistance value of the resistor 5, and the resistance value of the resistor 6 are represented by $I_1$, $I_2$, $R_5$, and $R_6$, respectively, the output voltage $V_0$ is expressed by the equation:

$$V_0 \cong V_{BE3} + \frac{R_5}{R_6} \cdot \frac{kT}{q} \ln \frac{I_1}{I_2} \quad (1)$$

in which k represents Boltzmann constant, and q represents the quantity of electric charge of an electron.

In the conventional circuit, the NPN transistor 3 of FIG. 1 performs a function of stabilizing the output voltage. The transistor 3 operates to absorb variations of the circuit current caused by the factors, such as variations in power source (that is, variations of the output current of the constant-current power source 7), variations in load connected to the output, and the like, to thereby keep the currents $I_1$, $I_2$ and the like constant.

The output current $I_{CC}$ of the constant-current power source 7 is the sum of the current $I_1$ flowing in the resistor 4, the current $I_2$ flowing in the resistor 5, and the collector current $I_{C3}$ of the NPN transistor 3 (the current $I_2$ being the sum of the collector current $I'_2$ of the NPN transistor 2 and the base current $I_{B3}$ of the NPN transistor 3). In order to keep the output voltage $V_0$ constant regardless of the change of output current $I_{CC}$, current $I_1$ should be constant or in other words current $I'_2$ should be constant. Accordingly, the variations of the output current $I_{CC}$ should be reflected mainly in the collector current $I_{C3}$ of the NPN transistor 3. The constant-current circuit composed of the resistors 4 and 6 and the transistor 1 and 2 has high impedance in the region of current larger than the collector current $I'_2$ of the NPN transistor 2, so that when viewed from the constant-current power source 7, the resistor 5 and the base-emitter of the NPN transistor 3 are in the form of a series connection. Accordingly, the variations of the output current $I_{CC}$ cause variations of the base current $I_{B3}$ of the NPN transistor 3, and hence, variations of the collector current $I_{C3}$ which is the product of the base current $I_{B3}$ and the current amplification factor $h_{FE}$. In short, the variations in the constant-current power source 7 or the like are absorbed by the NPN transistor 3.

However, in fact, the current amplification factor $h_{FE}$ of the NPN transistor 3 has a finite value, and if the collector current of the NPN transistor 3 changes, the base current of the same changes corresponding to the value of the current amplification factor $h_{FE}$. Because the current $I_2$ flowing in the resistor 5 is equal to the sum of the collector current of the NPN transistor 2 and the base current of the NPN transitor 3, the current $I_2$ changes if the base current of the NPN transistor 3 changes. If the current I2 changes, the temperature coefficient of the terminal voltage across the resistor 5 changes, so that the temperature coefficient of the output voltage $V_0$ is not kept zero to thereby exert an influence on the output voltage.

In the following, an example of variations of the current $I_2$ is described.

Assuming that the values of the resistor 5, the current amplification factor $h_{FE}$ of the NPN transistor 3, the base-emitter voltage $V_{BE3}$ of the NPN transitor 3, and output voltage $V_0$ are 6 kΩ, 100, 0.7 V, and 1.2 V, respectivley, then the current $I_2$ takes the value of about 833 μA from the following equation.

$$I_2 = (V_0 - V_{BE3})/R_5 \quad (2)$$

If a current variation of 1 mA is applied under this condition, the variation $\Delta I_2$ of the base current $I_2$ of the NPN transistor 3 takes the value of 10 μA from the following equation.

$$\Delta I_2 = 1\ \text{mA}/h_{FE} \quad (3)$$

Accordingly, the variation in the terminal voltage across the resistor 5 takes the value: 6 kΩ×10 μA=60 mV, or in other words the terminal voltage across the resistor 5 changes by 5% with respect to output voltage $V_0$=1.2 V.

Although description has been made as to variations in output due to variations in power source as well as due to variations in load, it is to be understood that variations in output depend on the fact that the current amplification factor $h_{FE}$ of the NPN transistor used for stabilization of output is limited. Accordingly, variations in output voltage are not avoidable also in the case where the current amplification factor $h_{FE}$ changes.

SUMMARY OF THE INVENTION

An object of the present invention is to provide a stabilized reference voltage circuit in which variations in output voltage due to variations in power source, in load, in current amplification factor ($h_{FE}$) of transistor, and the like, are reduced to thereby stabilize the output reference voltage.

Another object of the present invention is to provide a reference voltage circuit which is simplified in arrangement by replacing a conventional constant-current power source by a low-stabilized DC power source.

In order to attain the foregoing objects, the reference voltage circuit according to one aspect of the present invention comprises: a DC power source; a first resistor having one end connected to a high-potential side terminal of the DC power source; a second resistor having one end connected to the high-potential side terminal; a first NPN transistor having a base, a collector connected to the base and to the other end of the first resistor, and an emitter connected to a low-potential side terminal of the DC power source; a second NPN transistor having a collector connected to the other end of the second resistor, a base connected to the collector of the first NPN transistor, and an emitter; a third resistor connected between the emitter of the second NPN transistor and the low-potential side terminal of the DC power source; a third NPN transistor having a base connected to the collector of the second NPN transistor, an emitter connected to the low-potential side terminal, and a collector; a fourth resistor having one end connected to the high-potential side terminal, and the other end connected to the collector of the third NPN transistor; and a PNP transistor having a base connected to the collector of the third NPN transistor, an emitter connected to the high-potential side terminal, and a collector connected to the low-potential side terminal. The high-potential side terminal or the low-potential side terminal forms an output terminal of the reference voltage circuit.

Being multiplied by the current amplification factor $h_{FE}$ of the PNP transistor, the current amplification factor $h_{FE}$ of the third NPN transistor can be greatly enlarged so as to reduce variations in base current of the third NPN transistor. The fourth resistor connected to the collector of the third NPN transistor supplies the collector currrent for the third NPN transistor at all times to thereby compensate the variations in base current of the PNP transistor so as to stabilize the operation of the third NPN transistor.

DESCRIPTION OF THE PREFERRED EMBODIMENTS

An embodiment of the present invention will be described in detail with reference to FIG. 2.

Figure 2:
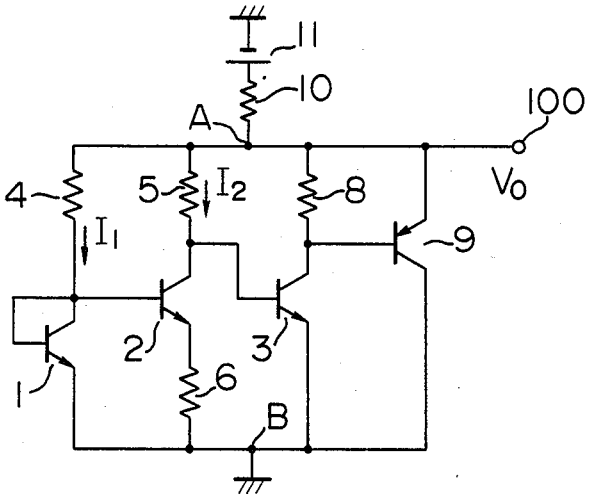
FIG. 2 is a wiring diagram showing an embodiment of the reference voltage circuit according to the present invention.

In FIG. 2, the respective one ends of resistors 4, 5, 8 and 10 are commonly connected to an output terminal 100, and the other end of the resistor 10 is connected to a high-potential side terminal of a constant-voltage DC power source 11. A low-potential side terminal of the DC power source 11 is grounded. The resistor 10 and the DC power source 11 constitute a constant-current power source in which A represents the high-potential side terminal, and B represents the low-potential side terminal. The high-potential side temrinal A is equal in electric potential to the output terminal, and the low-potential side terminal is equal in electric potential to the ground (GND). The other end of the resistor 4 is connected to the collector of an NPN transistor 1 with its base and collector short-circuited and connected to the base of an NPN transistor 2. The emitter of the NPN transistor 1 is directly connected to the GND, and the emitter of the NPN transistor 2 is connected to the GND through a resistor 6. The other end of the resistor 5 is connected to both the collector of the NPN transistor 2 and the base of an NPN transistor 3 with its emitter grounded. The other end of the resistor 8 is connected to both the collector of the NPN transistor 3 and the base of a PNP transistor 9 with its emitter and collector respectively connected to the output terminal 100 and the GND.

Figure 1:
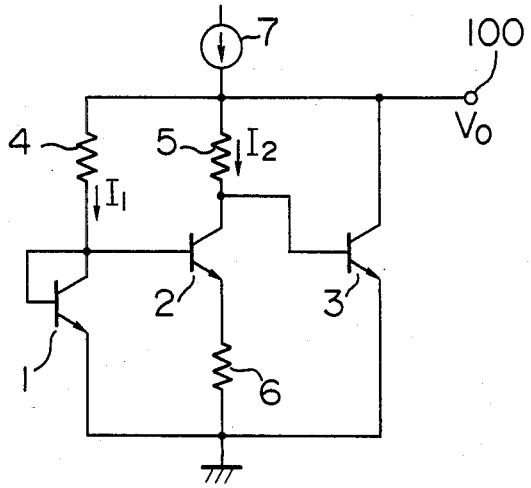
FIG. 1 PRIOR ART
FIG. 1 is a wiring diagram showing a conventional reference voltage circuit.

The output voltage $V_0$ is the sum of the potential difference $V_{BE3}$ between the base and the emitter of the NPN transistor 3 and the terminal voltage across the resistor 5 in the same manner as in the case of the conventional circuit of FIG. 1. That is, the output voltage is expressed by the equation (1).

In this embodiment, variations in circuit current due to variations in power source as well as in load are almost absorbed by the PNP transitor 9. Both the base current of the PNP transistor 9 and the current from the resistor 8 flow in the NPN transitor 3. By establishing the resistor 8 so that a current sufficiently larger than the base current of the PNP transistor 9 can flow in the resistor 8, it is possible to make the variations in the base current of the PNP transistor 9 hardly exert an influence onto the collector current or base current of the NPN transistor 3. In the following, an example of actual numerical values is shown.

Assuming that the resistance value of the resistor 5 is 6 kΩ similarly to the conventional case, that the current amplification factor $h_{FE}$ and the base-emitter potential difference $V_{BE}$ in each of the NPN transistor 3 and the PNP transistor 9 are 100 and 0.7 V, respectively, and that the collector current of the NPN transitor 3 is 200 μA, then the resistor 8 takes the value: 0.7 V/200 μA=3.5 kΩ. If the variation in current of 1 mA is applied in the same manner as in the conventional case, the variation in base current $\Delta I_{BP}$ of the PNP transistor 9 takes the value of 10 μA from the following equation.

$$\Delta I_{BP}=1\ \text{mA}/h_{FE} \quad (4)$$

Accordingly, the collector current of the NPN transistor 3 takes the value of 200 μA±10 μA, and the base current $I_{BN}$ takes the value of 2 μA±0.1 μA from the following equation.

$$I_{BN}=(200\ \mu\text{A}\pm 10\ \mu\text{A})/h_{FE} \quad (5)$$

Accordingly, the variation in base current is 0.1 μA. The variation in base current causes the variation of the current $I_2$ flowing in the resistor 5. Accordingly, the variation in terminal voltage across the resistor 5 takes the value 6 kΩ×0.1 μA=0.6 mV, or in other words the terminal voltage across the resistor 5 changes by 0.05% with respect to the output voltage $V_0$ (which is assumed to be 1.2 V as stated previously in the conventional case). It is to be understood that the variation of the terminal voltage is reduced to 1/100 in comparison with the conventional case.

FIG. 2 shows the case where the constant-current power source 7 in the conventional circuit of FIG. 1 is replaced by a DC power source 11 and a resistor 10. This is because the necessity of stabilization of the current fed from the constant-current power source becomes little owing to the reduction of variations in output voltage change with respect to the variations in current as described above, so that simplification of the circuit can be obtained.

Although the variations in current supplied for the circuit has been described above, this embodiment has also an excellent characteristic with respect to variations in transitor current amplification factor $h_{FE}$. That is, because the current amplification factor $h_{FE}$ of the NPN transistor 3 is apparently multiplied by the current amplification factor $h_{FE}$ of the PNP transistor 9 and because the variations in collector curren of the NPN transistor 3 can be suppressed against the variations in current amplification factor $h_{FE}$ of the PNP transistor 9 by the resistor 8 provided to supply the NPN transistor 3 with its collector current which is so small that the variations in base current of the PNP transistor 9 can be neglected, it is possible to make the influence on the base current of the NPN transistor 3 very small. By properly establishing the collector current owing to the resistor 8, the variations in base current of the NPN transistor 3 can be suppressed regardless of both the power source and the load to thereby obtain a stabilized output voltage. However, according to the conventional circuit, the collector current cannot be established to the optimum value by the inside factors in the reference voltage circuit, because the collector current of the NPN transistor 3 is determined by external factors such as a power source, a load and the like.

Figure 3:
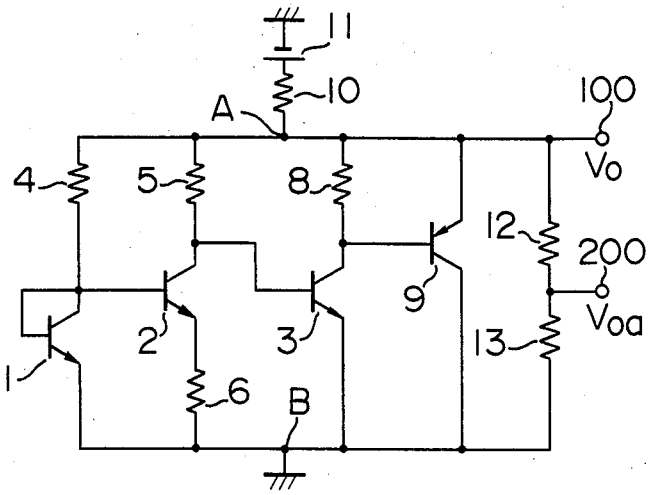
FIG. 3 is a wiring diagram showing another embodiment of the reference voltage circuit according to the present invention.
Figure 4:
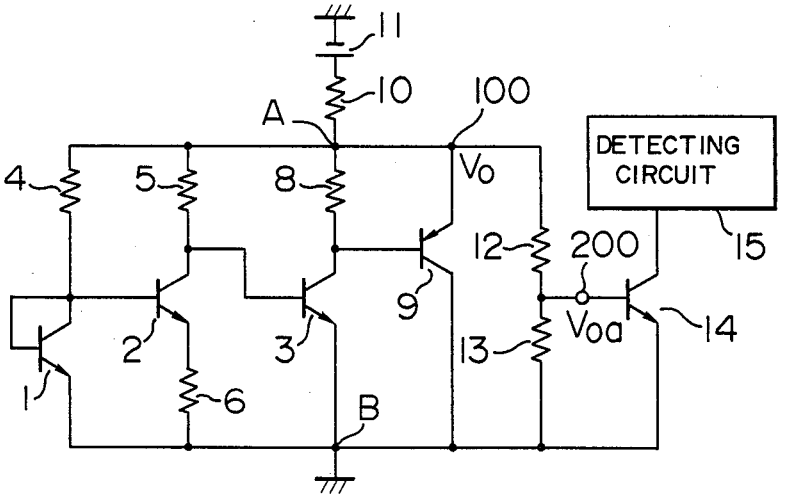
FIG. 4 is a wiring diagram showing a further embodiment of the reference voltage circuit according to the present invention.

FIGS. 3 and 4 respectively show other embodiments according to the present invention.

Referring to FIG. 3, there is shown an embodiment in which resistors 12 and 13 are provided between the output terminal 100 of FIG. 2 and the GND, and a further output terminal 200 is led out from the junction point between the resistors 12 and 13.

In FIG. 3, the output voltage $V_{0a}$ is expressed by the equation:

$$V_{0a} = V_0 \frac{R_{13}}{R_{12} + R_{13}}$$

in which $R_{12}$ and $R_{13}$ represent the resistance values of the resistors 12 and 13. The output voltage $V_{0a}$ can be suitably established within a range of from 0 V to $V_0$. Because the accuracy of the output $V_{0a}$ is determined by the relative accuracy of the resistors 12 and 13, considerably good accuracy can be expected under the use of semiconductor devices.

FIG. 4 shows the case where there is further provided an NPN transistor 14 having a base connected to the output terminal 200 and an emitter grounded. A detecting circuit 15 is arranged to detect the ON-state of the NPN transistor 14 to perform a given operation.

According to FIG. 4, a temperature detecting circuit can be realized. In the following, the circuit is described more in detail.

It is apparent from the prior art that the temperature coefficient of the output voltages $V_0$ and $V_{0a}$ in FIGS. 2 and 3 can be designed to be nearly zero.

In the equation (1), the first term $V_{BE3}$ of the right member has a negative temperature coefficient. Accordingly, if the values of $I_1$ and $I_2$ are established so that the second term of the right member is positive, the temperature coefficient of the output voltage $V_0$ can be zero for the resistance value of the resistor $R_5$ suitably selected to match the temperature coefficient of the $V_{BE3}$ (a resistor having a positive temperature coefficient).

The output voltage $V_{0a}$ is a division of the output voltage $V_0$ obtained through a resistance type voltage divider composed of the resistors $R_{12}$ and $R_{13}$. Accordingly, if the resistors 12 and 13 are selected to have the same resistance value, the output voltage $V_{0a}$ has the same temperature coefficient as that of the output voltage $V_0$. If the resistors 12 and 13 are selected to have different values, the output voltage $V_{0a}$ has a certain temperature coefficient even though the temperature coefficient of the output voltage $V_0$ is zero. (Even though the resistors 12 and 13 are equal in temperature coefficient, the relative rate thereof changes depending on the temperature.) In this case, the output voltage $V_0$ may be suitably selected to have a certain temperature coefficient by properly selecting the resistance value of the resistor 5 so as to match with the temperature coefficient with respect to the relative ratio of the resistors 12 and 13.

Accordingly, it is possible that the base voltage of the NPN transistor 14 in FIG. 4 is biased to a constant voltage without depending on the temperature. On the other hand, the potential difference $V_{BE}$ between the base and emitter of the NPN transistor 14 has a negative temperature coefficient and is reduced in the rate of about $-2$ mV/°C. with the rise of temperature. Accordingly, if the output voltage $V_{0a}$ is set to a value a little lower than the base-emitter potential difference $V_{BE}$ so as to prevent the NPN transistor 14 from operating at a low temperature, the NPN transistor 14 can be operated at the point in time when the temperature rises so that base-emitter potential difference $V_{BE}$ is reduced to a value lower than the output voltage $V_{0a}$. The setting of temperature for causing the NPN transistor 14 to operate can be adjusted by the value of the output voltage $V_{0a}$, that is, the setting values of the respective resistors 12 and 13. According to the circuit, the junction temperature of semiconductor devices can be detected, and the circuit is applicable to the protection of semiconductor devices from overheating or the like.

Figure 5:
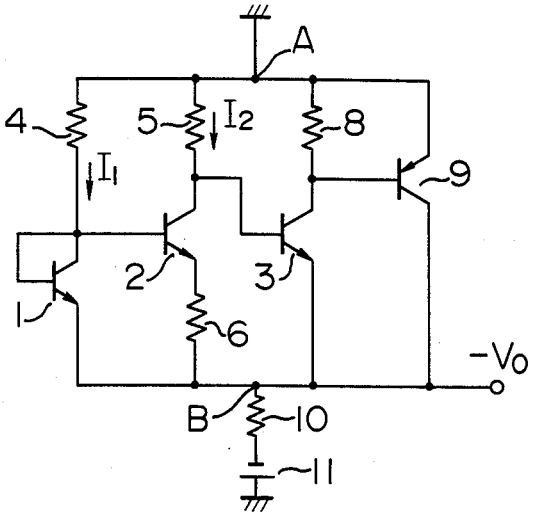
FIGS. 5 and 6 are wiring diagrams respectively showing further embodiments of the reference voltage circuits according to the present invention.
Figure 6:
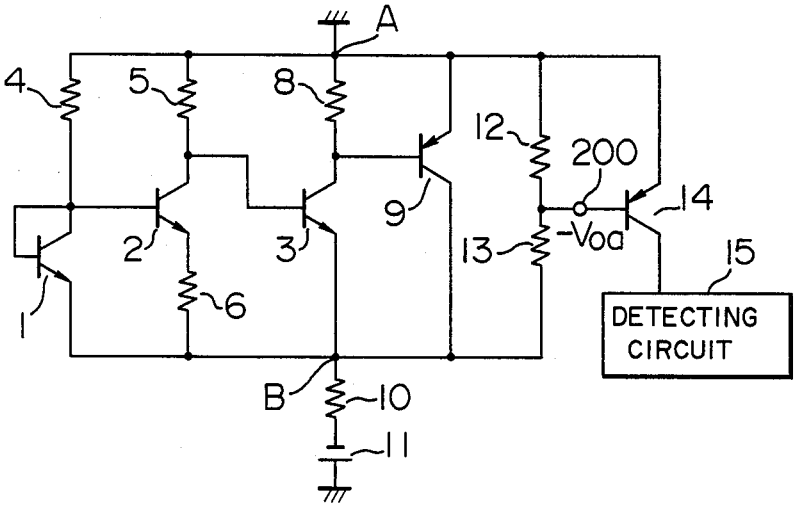

FIGS. 5 and 6 show modifications of the embodiments of FIGS. 2 and 4. In each of the modifications, the position of the power source 11 is reversed but the direction of current is the same as that in each of FIGS. 2 and 4. The operation in each of the modifications is made in the same manner as in each of FIGS. 2 and 4 except that the output voltage has a negative value.

According to the present invention, it is possible to easily obtain a reference voltage circuit in which variations in output voltage due to variations in power source, as well as in transistor current amplification factor $h_{FE}$ are reduced to thereby stabilize the output reference voltage. Accordingly, the reference voltage circuit can be widely used for various industrial purposes, such as reference voltage sources for semiconductor integrated circuits, thermal shut-down circuits in dot printer driver ICs, and the like.

What is claimed is:

1. A reference voltage circuit comprising:

(a) a DC power source;

(b) a first resistor having one end connected to a high-potential side terminal of said DC power source;

(c) a second resistor having one end connected to said high-potential side terminal;

(d) a first NPN transistor having a base, a collector connected to said base and to the other end of said first resistor and an emitter connected to a lowpotential side terminal of said DC power source;

(e) a second NPN transistor having a collector connected to the other end of said second resistor, a base connected to the collector of said first NPN transistor and an emitter;

(f) a third resistor connected between the emitter of said second NPN transistor and the low-potential side terminal of said DC power source;

(g) a third NPN transistor having a base connected to the collector of said second NPN transistor, an emitter connected to said low-potential side terminal and a collector;

(h) a fourth resistor having one end connected to said high-potential side terminal and the other end connected to the collector of said third NPN transistor;

(i) a PNP transistor having a base connected to the collector of said third NPN transistor, an emitter connected to said high-potential side terminal and a collector connected to said low-potential side terminal; and (j) an output terminal lead out from a selected one of said high-potential side terminal and said low-potential side terminal.

2. A reference voltage circuit according to claim 1, in which said DC power source is a constant-current power source.

3. A reference voltage circuit according to claim 2, in which said constant-current power source is constituted by a constant-voltage power source and a resistor serially connected to said power source.

4. A reference voltage circuit according to claim 1, further comprising a fifth and a sixth resistor connected in series to each other between said high-potential side terminal and said low-potential side terminal and a second output terminal lead out from a junction point between said fifth and sixth resistors.

5. A reference voltage circuit according to claim 4, further comprising a fourth NPN transistor having a base connected to the junction point between said fifth and sixth resistors, an emitter connected to said low-potential side terminal and a collector connected to a detecting circuit.

6. A reference voltage circuit according to claim 4, further comprising a second PNP transistor having a base connected to the junction point between said fifth and sixth resistors, an emitter connected to said high-potential potential side terminal and a collector connected to a detecting circuit.

7. A reference voltage circuit comprising:

(a) an output terminal;

(b) a DC power source connected at its high-potential side to said output temrinal and grounded at its low-potential side;

(c) a first resistor having one end connected to said output terminal;

(d) a second resistor having one end connected to said output terminal;

(e) a first NPN transistor having a base, a collector short-circuited with said base and connected to the other end of said first resistor and an emitter grounded;

(f) a second NPN transistor having a collector connected to the other end of said second resistor, a base connected to the collector of said first NPN transistor and an emitter;

(g) a third resistor connected between the emitter of said second NPN transistor and the ground;

(h) a third NPN transistor having a base connected to the collector of said second NPN transistor, an emitter grounded and a collector;

(i) a fourth resistor having one end connected to said high-potential side terminal and the other end connected to the collector of said third NPN transistor;

(j) a PNP transistor having a base connected to the collector of said third NPN transistor, an emitter connected to said output terminal and a collector grounded.

8. A reference voltage circuit according to claim 7, in which said DC power source is a constant-current power source.

9. A reference voltage circuit according to claim 8, in which said constant-current power source is constituted by a constant-voltage power source and a resistor serially connected to said power source.

10. A reference voltage circuit according to claim 7, further comprising a fifth and a sixth resistor connected in series to each other between said output terminal and the ground and a second output terminal lead out from a junction point between said fifth and sixth resistors.

11. A reference voltage circuit according to claim 10, further comprising a fourth NPN transistor having a base connected to the junction point between said fifth and sixth resistors, an emitter grounded and a collector connected to a detecting circuit.

* * * * *